United States Patent [19]

Timmann et al.

[11] 4,082,051

[45] Apr. 4, 1978

[54] CONTAINER SHIP CONSTRUCTION

[75] Inventors: Peter Timmann, Lubeck; Heinrich A. Steinborn, Bad Schwartau, both of Germany

[73] Assignee: O & K Orenstein & Koppel Aktiengesellschaft Werk Lubeck, Germany

[21] Appl. No.: 704,485

[22] Filed: Jul. 12, 1976

[30] Foreign Application Priority Data

Jul. 15, 1975 Germany ..... 2531487

[51] Int. Cl.[2] ..... B63B 11/02

[52] U.S. Cl. ..... 114/72

[58] Field of Search ..... 114/26, 72, 77 A, 63, 114/76, 85, 65 R

[56] References Cited

U.S. PATENT DOCUMENTS

| | | | |
|---|---|---|---|
| 1,507,284 | 9/1924 | Hensen | 114/26 |
| 1,578,626 | 3/1926 | Baer | 114/26 |
| 3,827,384 | 8/1974 | Lunde | 114/72 |

FOREIGN PATENT DOCUMENTS

| | | | |
|---|---|---|---|
| 1,488,509 | 7/1967 | France | 114/72 |
| 2,521,820 | 4/1975 | Germany | 114/72 |
| 647,370 | 10/1962 | Italy | 114/72 |

*Primary Examiner*—Trygve M. Blix
*Assistant Examiner*—Stuart M. Goldstein
*Attorney, Agent, or Firm*—McGlew and Tuttle

[57] ABSTRACT

The container ship comprises a hull having outer starboard and port sides with a bottom extending between the sides and with longitudinal bulkheads spaced inwardly from each side and extending substantially coextensive in height above the bottom to the side walls. A bracing deck interconnects the side walls and the longitudinal bulkheads at the level of the tops of the side walls and the bulkheads. A container bottom loading space is defined above the bottom and between the longitudinal bulkheads and this space continues above the bracing deck to form a top container loading space. For this purpose a plurality of top longitudinal walls extend upwardly above the bracing deck and are supported thereon. The plurality of transverse support frames extend above and are supported on the bracing deck and connected to the longitudinal walls at spaced longitudinal intervals. A plurality of container support racks are secured along each longitudinal wall and extend upwardly from the bottom to the tops of the longitudinal walls. The complete construction includes an end wall at each end of the loading space and each loading space is advantageously covered by one or more hatch covers.

8 Claims, 4 Drawing Figures

CONTAINER SHIP CONSTRUCTION

BACKGROUND OF THE INVENTION

1. Field of the Invention

This invention relates in general to the construction of ships and in particular to a new and useful container ship particularly for cooling containers having a loading space extending above the vessel side walls and longitudinal bulkheads which is defined by upright longitudinal walls extending above a bracing deck and by transversely extending supporting frames having supports for stowing individual containers and for connecting them to a means for circulating a cooling medium through the container.

2. Description of the Prior Art

The present invention is particularly applicable for the construction of a cooling container ship. Shelter decks are known for ships which terminate at the top in a structure which is not designed as a supporting longitudinal bracing of the ship. The height of this structure exceeds the conventional height of the deck. The side walls of the structure are adjoined by parts which support the sttucture on both sides and which have a height which is less than the height of the structure. The lateral part of the structure terminates short of the ship ends and in turn are terminated by shelter decks. The lateral corridors thus formed can be used for storing high tanks which form balancing means for the stability of the ship. The upper supporting longitudinal cords of the hull are arranged in the decks of this laterally embracing part of the shelter deck. Such a construction which does not concern a cooling container ship serves to provide a fully removable shelter deck space so that the surveying advantages of the normal shelter deck ship are maintained.

A seagoing vessel with a loading spaced for container transport which is open at the top and protected at the front and sides by stationary walls is known and the containers of such a vessel are stowed above the weather deck without conventional stowing racks. The container loading spaces are also protected at the rear by stationary walls. The loading space can be covered at the top by a tarpaulin. In such ships the containers are exposed to the surrounding air, to precipitation and spray water from the and to outside temperature fluctuations. These ships offer no possibility for storing containers at constant temperature particularly for cooling the containers.

Two different types of constructions are known for cooling the containers in cooling container ships. One construction of a cooling container ship is equipped with at least one hold and with a cooling plant fixedly mounted on the ship for cooling the heat insulated containers stored inside the ship. The entire air of the stowing space is circulated and conducted through a heating or cooling device which can be arranged in the space between the hull of the ship and a longitudinal bulkhead forming the wall of the loading space. The air is exhausted at the bottom end of the stowing space and conducted through the heating and/or cooling device and forced through the upper part of the stowing space back into the device. The air thus surrounds the containers. A disadvantage in this construction is that the entire space above the bracing deck of the ship remains unused for storing containers.

In another construction of a cooling container ship, the loading station is not provided with an insulation against heat radiation from the outside as in the construction mentioned above. On one or several walls of the bulkheads extending in the longitudinal or traverse direction of the ship and secured in the loading space is an air cooling plant. Connected to this cooling plant are one or more air ducts on which are arranged nipples or couplings for connection to the cooling containers. The air ducts are designed as double ducts, one of which carries the supply air and other the return air. The air ducts are heat insulated and each container is provided with two connections one serving for the supply and the other for the return. In this construction also the loading space is terminated at the normal level by an upper hatch and the space above the hatch is not included in the ship's own cooling system.

It is also known to use the space above the normal bracing deck for storing cooling containers where the cooling containers are provided with special cooling devices which are principally of the electrical type and which are connected to current supply cables on deck. A disadvantage of this construction is that the cooling containers are exposed to the surrounding air and precipitation and spray water, etc. Each container stored on deck must be washed and attended separately.

SUMMARY OF THE INVENTION

The present invention provides a container ship, particularly a cooling container ship, which is designed so that there is an increased loading spaced formed above the hold of the vessel for the storage of cooling containers with a light load for example in a greater number than known heretofore. If possible the cooling containers should be connected to the ship's own cooling system so that it is not necessary to install and connect cooling devices.

In accordance with the invention the spaces for increasing the loading space are provided above the bracing deck by the provision of longitudinal walls which are advantageously made extensible or which may be divided by interruptions as well as by cross bulkheads and end walls. Individual spaces forming loading spaces above the bracing deck communicate with the loading space beneath the bracing deck and each loading space is advantageously terminated by known hatch covers and they are provided with means along their length and height for stowing the containers therein. The invention has the advantage that a greatly increased loading space extending from the top to the bottom of the ship is provided which serves entirely for stowing containers and the containers and the containers may be protected and closed off against the weather and connected to the ship's own cooling system. The arrangement is such that all containers may be fully protected against the surrounding air, rain, spray water, etc.

According to another feature of the invention several frames or pairs of frames extending from one side wall of the ship to the other can be arranged to absorb transverse forces. The longitudinal walls are secured on the frames or pairs of frames. The pairs of frames carry a deck construction and hatch cover on their top. In another embodiment several frames of pairs of frames extending from one extensible longitudinal wall to the other extensible longitudinal wall are arranged to absorb transverse forces. The extensible walls can be designed in various ways. In one embodiment the extensible longitudinal walls are designed as folding walls. In another embodiment the extensible longitudinal walls comprise stiffened plate panels which are connected with each other by expansion joints. The construction advantageously includes cooling rod connections for the supply and discharge of a cooling air and these connections can be extended upwardly into the spaces formed above the lower loading space and the spaces are advantageously provided with connections for each container. In this embodiment the cooling rods for the supply and discharge of cooling air can be arranged in the space between pairs of frames or between the bulkhead and the frame, etc. in their outer region in which case the connecting means protrude through the frames to the outside so that the containers can be arranged and connected outside the space provided according to the invention.

When an arrangement is such that the cooling air in the loading space is exhausted and returned after passing through the cooling device back into the loading space, the air can be exhausted into the lower part of the loading space and in accordance with another feature of the invention can be forced again into the upper part of the space provided in the inventive arrangement. The frames can be connected with each other by horizontal supports extending in longitudinal directions and which support the frames against each other and which can also be used for example to hold the vertical guide rails for the container stowage. In large cooling container ships it may be advisable to support the room by central or lateral supporting walls and to divide the hatch covers correspondingly.

Accordingly it is an object of the invention to provide a cooling container ship which comprises a hull having an outer starboard and port sides with a bottom structure extending between the sides and with a longitudinal bulkhead spaced inwardly from each side and extending substantially coextensive in height above said bottom to said side walls and which also includes a transverse bracing deck interconnecting the side walls and the longitudinal bulkheads at the level of the top thereof and with the ship defining a container bottom loading space above the bottom and between the longitudinal bulkheads and a top loading space above the bottom loading space which is terminated at each side by a plurality of longitudinal walls extending upwardly from the bracing deck and supported on the bracing deck and which also includes a plurality of transverse support frames extending above and supported on the bracing deck and connected through their longitudinal walls at spaced longitudinal intervals to define at least one loading space between frames and longitudinal walls which may be covered by a hatch cover and which advantageously includes means associated with the bottom loading space and the top loading space for stowing containers and for supplying heating or cooling media thereto as necessary.

A further object of the invention is to provide a container ship which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

GENERAL DESCRIPTION OF THE PREFERRED EMBODIMENTS

Figure 3:
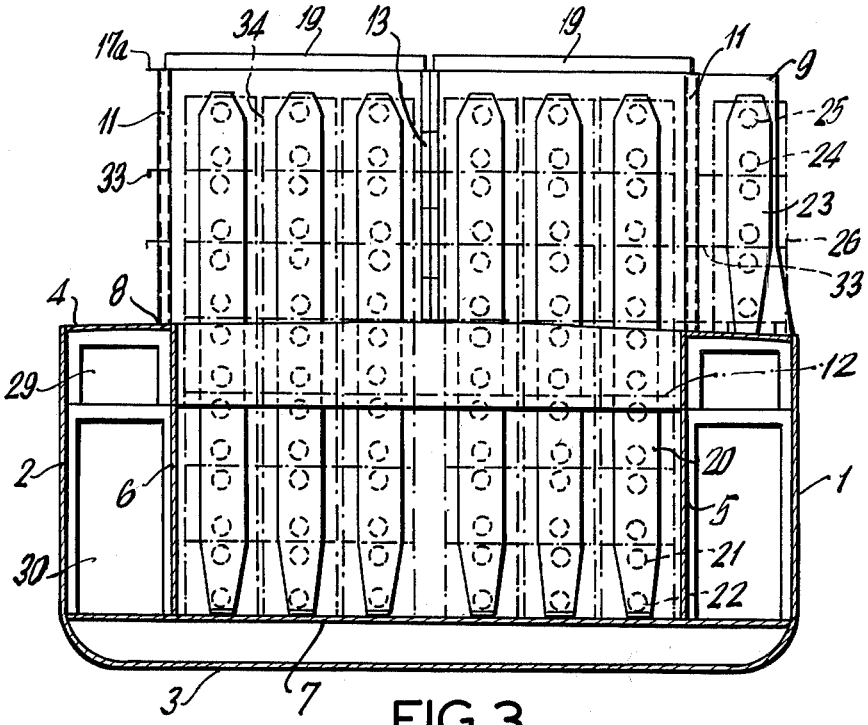
FIG. 3 is a section taken along the line A—A of FIG. 2.
Figure 4:
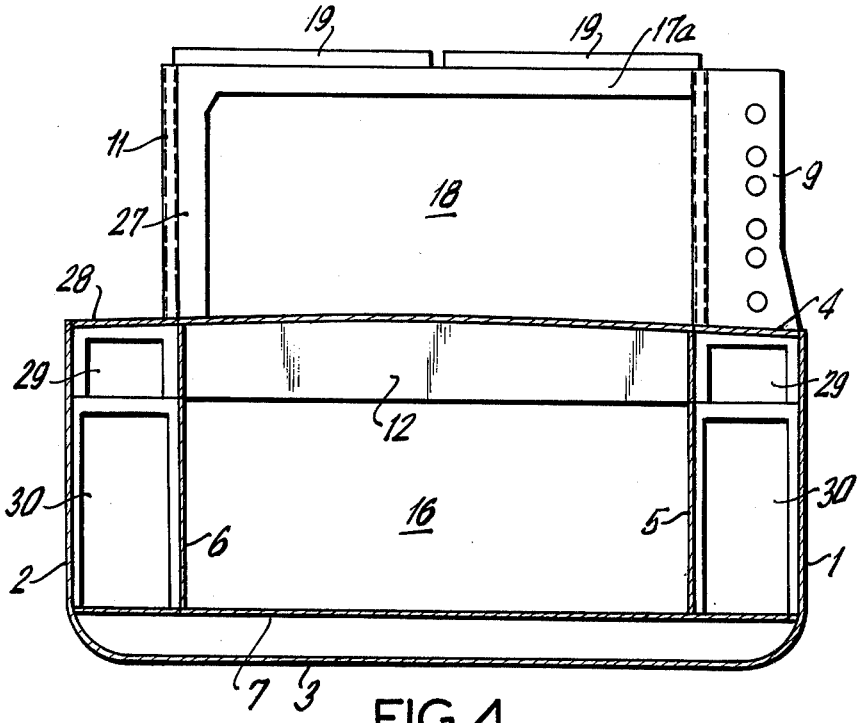
FIG. 4 is a section taken along the line B—B of FIG. 2.

Referring to the drawings in particular the invention embodied therein comprises a container ship which is advantageously a cooling container ship which includes a hull generally designated 50 having a starboard side 1 and a port side 2 forming outer walls which extend upwardly from a bottom structure 3 to a bracing deck 4 which interconnects each side wall 1 and 2 at its top and which also interconnects the tops of longitudinally extending bulkheads 5 and 6 spaced inwardly from the outer walls 1 and 2. These parts form the load bearing construction of the ship and the bulkheads which extend longitudinally limit the side area of a bottom loading space 16 as shown in FIGS. 3 and 4. The longitudinal bulkheads 5 and 6 traverse the hull from the inner bottom 7 to the bracing deck 4.

In accordance with the invention the upper edge of the bracing deck 4 carries right angled U-shaped section frames 9 which form transverse support elements and divisions between the length of longitudinal walls 11 which also extend upwardly from the bracing deck 4 and are secured thereto. In the embodiment illustrated the longitudinal walls are designed as foldable walls which may be extended or retracted.

Figure 1:
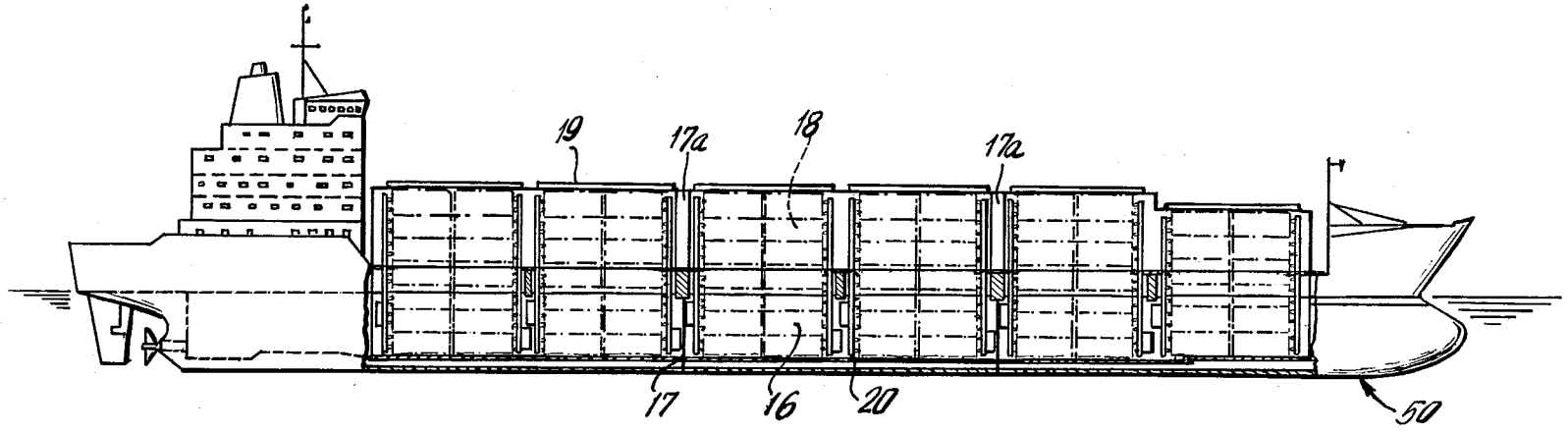
FIG. 1 is a side elevational view partly in section of a container ship constructed in accordance with the invention.
Figure 2:
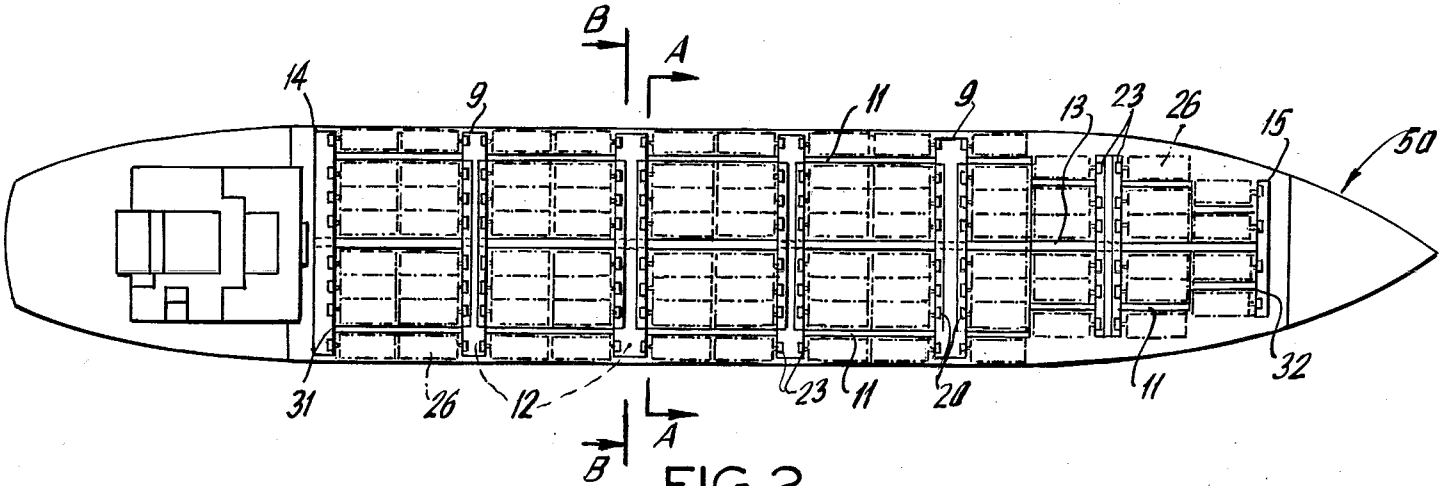
FIG. 2 is a top plan view of the ship shown in FIG. 1.

The bracing 4 forms a frame whose inner edges are connected at several points by crossbars 12 which are generally in a box frame type of construction. Crossbars 12 carry a central supporting wall 13 which extends upwardly from the crossbars and along the length of the ship between end frames 14 and 15 as shown in FIG. 2. The supporting wall 13 is advantageously provided with means for facilitating passage of the transverse member such as the frames 9. The bottom loading space 16 which is formed in the hull below the bracing deck is subdivided as usual by transverse bulkheads 17 which protrude upwardly into a top loading space 18 formed between the longitudinal walls 11. The frame 9, the longitudinal walls 11, the central supporting wall 13 and the transverse bulkheads 17 with a sealing construction **17*a* added at the top thereof in closed rectangular areas which are closed at the top by hatch covers 19 which define the upper limit of the loading space 18. The loading spaces 18 are terminated at respective ends by end walls 31 and 32. Container stowing frames 34 are arranged to traverse the entire spaces 16 and 18** over their whole height.

The containers which are not shown individually are connected to so-called cooling rods 20 which extend upwardly from the inner bottom 7 and traverse the spaces 16 and 18. These cooling rods 20 each include a cooling air supply and a cooling air exhaust pipe and they are provided with corresponding connecting means 21 and 22 to which the containers are connected in a known manner.

In order to better utilize the space the cooling rods 23 are also arranged in the U-section of the frames 9 and their connecting means 24 and 25 traverse the frames 9 to the outside for the connection of the containers so that containers 26 can be stowed outside the longitudinal walls 11 on the bracing deck 4 and also be connected to the cooling system.

On the left side of FIGS. 3 and 4 there is shown another construction wherein the frames 9 do not connect the outside walls 1 and 2 of the ship, but where other frames 27 are secured on the inside of the bracing deck 4. This construction offers the possibility of arranging tracks for cranes for example on the free space 28 of the bracing deck 4. The space 29 located below the bracing deck 4 can serve as a corridor or as a space for the insulation of machines, etc. In the same manner the space 30 can serve as a fueling station. The frames 9 and 27 can be connected with each other by supports 33 extending in a longitudinal direction. Such supports serve with others to hold the container stowing racks 34 which traverse the spaces 16 and 18.

While specific embodiments of the invention have been shown and described in detail to illustrate the application of the principles of the invention, it will be understood that the invention may be embodied otherwise without departing from such principles.

What is claimed is:

1. A container ship comprising a hull having outer starboard and port side walls, a bottom structure extending between said side walls, a longitudinal bulkhead spaced inwardly from each side wall and extending substantially coextensive in height above said bottom to said side walls, a transverse bracing deck interconnecting said side walls and said longitudinal bulkheads at the level of the top of said side walls and bulkheads, said ship defining a container bottom loading space above said bottom and between said longitudinal bulkheads, said bracing deck including longitudinally spaced frame members extending transversely between said side walls and defining openings therebetween extending above said bottom loading space, a plurality of top longitudinal walls extending upwardly above and supported on said bracing deck, a plurality of transverse support frames extending above and supported on said bracing deck and connected to said longitudinal walls at longitudinally spaced intervals, support frames and longitudinal walls on each side of the ship forming a substantially continuous wall, a plurality of transverse bulkheads extending between said longitudinal bulkheads in said loading space and extending above said loading space adjacent said frames, the space between said longitudinal walls and said transverse bulkheads defining above said bracing deck an upper loading space, the lower and upper loading spaces containing continuous stowage rack means for containers extending upwardly from said bottom to the top of said longitudinal walls, and a hatch cover covering each loading space.

2. A container ship according to claim 1, wherein said transverse support frames extend between adjacent said longitudinal walls.

3. A container ship according to claim 1, including cooling rod means disposed in the upper and lower loading spaces having means for connection of supply and return of a cooling medium to said containers.

4. A container ship according to claim 3, wherein said cooling rod means are located in said frames and are connected to the outside of said frames so that the containers may be connected to the cooling system from the outside of the loading space.

5. A container ship according to claim 1, including a cooling device in said bottom loading space and upper loading space having means for circulating a cooling air through the individual loading spaces.

6. A container ship according to claim 1, including a plurality of horizontal supports extending longitudinally along said side walls.

7. A container ship according to claim 1, wherein said bracing deck includes a transverse frame member extending between each side thereof, a central longitudinally extending support wall extending along said ship, an end frame wall extending transversely across said ship at each end of said support wall closing off the top loading space at each end.

8. A container ship according to claim 1, including a transverse end wall closing each end of said upper loading space extending upwardly from said bracing deck.

* * * * *